US008980810B2

(12) United States Patent
Patil et al.

(10) Patent No.: US 8,980,810 B2
(45) Date of Patent: Mar. 17, 2015

(54) VINYL ETHER POLYMER FLUIDS MADE USING CONTROLLED LIVING CATIONIC POLYMERIZATION AND THEIR USE AS SYNTHETIC LUBRICANT BASESTOCKS

(75) Inventors: Abhimanyu O. Patil, Westfield, NJ (US); Satish Bodige, Wayne, NJ (US); Ranjan Tripathy, Lowell, MA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 289 days.

(21) Appl. No.: 13/332,478

(22) Filed: Dec. 21, 2011

(65) Prior Publication Data

US 2013/0165361 A1 Jun. 27, 2013

(51) Int. Cl.

| | |
|---|---|
| ***C10M 107/34*** | (2006.01) |
| ***C10L 1/18*** | (2006.01) |
| ***C08L 9/00*** | (2006.01) |
| ***C08L 11/02*** | (2006.01) |
| ***C08L 13/02*** | (2006.01) |
| ***C10M 107/20*** | (2006.01) |
| ***C10M 107/24*** | (2006.01) |
| ***C10M 145/04*** | (2006.01) |
| ***C10M 169/04*** | (2006.01) |

(52) U.S. Cl.

CPC ..... *C10M 169/04* (2013.01); *C10M 107/20* (2013.01); *C10M 107/24* (2013.01); *C10M 145/04* (2013.01); *C10M 2203/1006* (2013.01); *C10M 2203/1025* (2013.01); *C10M 2205/0285* (2013.01); *C10M 2205/173* (2013.01); *C10M 2209/04* (2013.01); *C10M 2209/043* (2013.01); *C10N 2220/021* (2013.01); *C10N 2220/022* (2013.01); *C10N 2230/02* (2013.01); *C10N 2230/70* (2013.01); *C10N 2240/10* (2013.01); *C10N 2270/00* (2013.01)

USPC ..... 508/579; 508/475; 524/459

(58) Field of Classification Search

USPC ..... 508/579, 475; 524/459

See application file for complete search history.

(56) References Cited

U.S. PATENT DOCUMENTS

| | | | | |
|---|---|---|---|---|
| 2,544,375 | A | 3/1951 | Butler | |
| 3,228,923 | A | 1/1966 | Scott et al. | |
| 3,468,856 | A | 9/1969 | Tokyo et al. | |
| 3,541,015 | A | 11/1970 | Schultz et al. | |
| 5,691,430 | A | 11/1997 | Dougherty et al. | |
| 2010/0093576 | A1* | 4/2010 | Maruyama et al. | 508/370 |

FOREIGN PATENT DOCUMENTS

| | | |
|---|---|---|
| CN | 1408829 | 4/2003 |
| GB | 413637 | 7/1934 |
| JP | 7062011 | 3/1995 |
| JP | 1993210734 | 3/1995 |

OTHER PUBLICATIONS

P.C. Chatterjee and J.S. Aggarwal, "Cationic Polymerization of Octadecyl Vinyl Ether with Anhydrous Stannic Chloride", Indian J. Chem., Apr. 1967, pp. 160-162, vol. 5.

A. Kanazawa, Y. Hirabaru, S. Kanaoka and S. Aoshima, "Fast Living Cationic Polymerization of Vinyl Ethers with Iron(III) Chloride in the Presence of a Cyclic Ether: Most Active and Environmentally Benign Catalyst for the Living Cationic Polymerization of Vinyl Ethers", J. of Polymer Science, Part A: Polymer Chemistry, 2006, 44(19), pp. 5795-5800.

A. Kanazawa, S. Kanaoka and S. Aoshima, "Recent Progress in Living Cationic Polymerization of Vinyl Ethers", Chem. Lett., 2010, pp. 1232-1237, vol. 39.

M. Sawamoto, "Modern Cationic Vinyl Polymerization", Prog. Polym. Sci., 1991, 16, pp. 111-172.

S. Aoshima and T. Higashimura, "Living Cationic Polymerization of Vinyl Monomers by Organoaluminum Halides. 3. Living Polymerization of Isobutyl Vinyl Ether by EtA1C12 in the Presence of Ester Additives", Macrom., 1989, 22, 1010-1013.

Y. Kishimoto, S. Aoshima and T. Higashimura, "Living Cationic Polymerization of Vinyl Monomers by Organoaluminum Halides. 4. Polymerization of Isobutyl Vinyl Ether by EtA1C12 in the Presence of Ether Additives", Macrom., 1989, 22, 3877-3882.

S. Aoshima and S. Kanaoka, "A Renaissance in Living Cationic Polymerization", Chemical Reviews, 2009, 109 (11), pp. 5245-5287.

A. Kanazawa, S. Kanaoka and S. Aoshima, "Major Progress in Catalysts for Living Cationic Polymerization of Isobutyl Vinyl Ether: Effectiveness of a Variety of Conventional Metal Halides", Macrom., 2009, 42, pp. 3965-3972.

A. Kanazawa, Y. Hirabaru, S. Kanaoka and S. Aoshima, "Fast Living Cationic Polymerization of Vinyl Ethers with Iron(III) Chloride in the Presence of a Cyclic Ether: Most Active and Environmentally Benign Catalyst for the Living Cationic Polymerization of Vinyl Ethers", Journal of Polymer Science: Part A: Polymer Chemistry, 2006, 44 (19), pp. 5795-5800.

* cited by examiner

*Primary Examiner* — Prem C Singh
*Assistant Examiner* — Francis C Campanell
(74) *Attorney, Agent, or Firm* — Robert A. Migliorini

(57) ABSTRACT

The synthesis of high performance polyvinyl ether (PVE) fluids using a Lewis acid based cationic polymerization process is disclosed. The polyvinyl ether fluid have repeating vinyl ether units of the general formula —[$CH_2$—CH(O—R)]$_n$, wherein R is comprised of a branched or linear alkyl group having at least 4 carbon atoms and n is a whole number representing the average number of repeating units in the polyvinyl ether. The resulting PVE fluids exhibit excellent lubricant properties, similar to poly-alpha olefins (PAOs), but the PVE fluids have the benefit of higher polarity than PAOs and thus have better solubility and dispersity of polar additives.

28 Claims, No Drawings

VINYL ETHER POLYMER FLUIDS MADE USING CONTROLLED LIVING CATIONIC POLYMERIZATION AND THEIR USE AS SYNTHETIC LUBRICANT BASESTOCKS

FIELD

The present disclosure relates to the synthesis of high performance polyvinyl ether (PVE) fluids using a using controlled living cationic polymerization processes. The resulting PVE fluids have low MWDs and have been shown to exhibit excellent lubricant properties, similar to poly-alpha olefins (PAOs). The PVE fluids have the benefit of higher polarity than PAOs, and thus have better solubility and dispersity of polar additives.

BACKGROUND

PAOs are a class of hydrocarbons that can be manufactured by the catalytic oligomerization (polymerization to low-molecular-weight products) of linear α-olefin (LAO) monomers. These LAO monomers typically range from 1-octene to 1-dodecene, with 1-decene being a preferred material. PAO's of different viscosity grades are typically produced by the polymerization of an LAO in the presence of a polymerization catalyst such as Friedel-Crafts catalysts. These include, for example, boron trifluoride, aluminum trichloride, or boron trifluoride promoted with water, with alcohols such as ethanol, propanol, or butanol, with carboxylic acids, with esters such as ethyl acetate or ethyl propionate, or with ethers such as diethyl ether, and diisopropyl ether. Subsequent to oligomerization, the PAO products desired to be used as lubricants are typically hydrogenated in order to reduce the residual unsaturation in the polymer, generally to a level of greater than 90% hydrogenation.

Currently, PAOs are used as basestocks in premium lubricant formulations. PAOs have many advantages over conventional mineral oil or other high quality lubricants. PAOs are important lube basestocks with many excellent lubricant properties, including high viscosity index (VI) and low volatility, and are available in various viscosity ranges ($Kv_{100}$ 2-300 centiStokes (cSt). PAOs are often considered the best of the hydrocarbon type lubricants. However, PAOs are paraffinic hydrocarbons with low polarity. This low polarity leads to low solubility and dispersancy for polar additives or sludge generated during service. To compensate for this low polarity, lubricant formulators usually add one or multiple polar co-basestocks. Esters or alkylated naphthalene (AN) is often used in PAO formulations at 1 wt. %-50 wt. % levels to increase the fluid polarity. Therefore, there is a need for a fluid exhibiting the lubricity parameters of PAO, but with built-in polarity in order to have excellent lubrication properties without the need for a co-basestock.

Methods for the preparation of polymers from vinyl alkyl ethers have been disclosed.

In Aoshima, S. et al., *Chemical Reviews*, (2009), 109(11), 5245-5287, American Chemical Society, relates to a review of living cationic polymerization initiators, including the design and synthesis of a variety of new polymers, with focus on the most recent developments. Polymerization of a large number of monomers is described, with emphasis on novel monomers and preparation of block and end-functionalized polymers of various chain structures.

In U.S. Pat. No. 3,228,923, it is disclosed that polymers of vinyl alkyl ethers can be prepared using monomers comprised of ethers having the general formula $H_2CO{=}CH{-}O{-}R$, where R is an alkyl radical of from 1-20 carbon atoms. It is stated that lower reaction temperatures yield a higher molecular weight polymer, and that the resulting polymers are viscous oils, sticky semi-solids or hard solids. The polymers are said to be useful as adhesives, lubrication oil additives, paint and lacquer resins, molding resins, coatings, and plasticizers/modifiers for various resins and plastics. In the only example provided, the resulting polymer was said to have particular use as an adhesive, and that "when any of the other above-identified vinyl alkyl ethers are substituted for those used in the foregoing example, substantially analogous results are obtained".

In U.S. Pat. No. 5,691,430 there is disclosed a process for polymerizing a vinyl ether monomer which comprises contacting the vinyl ether with an initiator system of silicon dioxide and a one or more metallic oxides. The vinyl ethers which are useful in the disclosed process are said to be those monomers having the formula $H_2C{=}CH{-}OR$, wherein R is an alkyl cycloalkyl or alkyl substituted cycloalkyl aromatic or alkyl substituted aromatic, and R is 1 to 20 carbon atoms. The polymerization initiator system is said to include silicon dioxide and one or more metallic oxides.

In U.S. Pat. No. 3,468,856 there is disclosed a process for the preparation of vinyl ether polymers by the polymerization of a vinyl ether in the presence of a multi-component catalyst system including (a) an organo aluminum compound of the general formula $AlXnR_3n$, wherein X represents a halogen atom, R is a member selected from alkyl cycloalkyl, aryl and aryl alkyl groups, and n is an integer of 0-2, (b) a carboxylic acid anhydride, and (c) a Friedel-Crafts halide.

In Chatterjee, P. et al., *Indian Journal of Chemistry* (1967), 5(4), 160-2, it is disclosed that octadecyl vinyl ether is cationically polymerized in a variety of solvents with anhydrous $SnCl_4$. The molecular weight-intrinsic viscosity relation for octadecyl vinyl ether polymers is said to be determined and the IR spectrum of the polymer recorded. It is also said that solvents with dielectric constants lower than that of the catalyst give better polymers compared with solvents with higher dielectric constants; the latter are said to give polymers having molecular weights <1000 or no polymerization at all.

In Kanazawa, A. et al., *Journal of Polymer Science*, Part A: Polymer Chemistry (2006), 44(19), 5795-5800, it is said that living cationic polymerization of iso-butyl vinyl ether was conducted in toluene in the presence of different Lewis acids (FeBr3, FeCl3, SnCl4, EtAlCl2) and/or in the presence of different bases (EtOAc, THF, 1,4-dioxane, and 1,3-dioxolane). Conversion, molecular weight, and polydispersity index of the resulting polymer were also said to be determined, and that basicity of base affected polymerization rate significantly. It is said that an appropriate combination of a weak Lewis base and FeCl3 realized very fast living cationic polymerization.

In JP 1993-210734, it is said that polymers with narrow molecular weight distribution (Mw/Mn) are prepared by living polymerization of vinyl or propenyl ethers by using living polymerization initiators containing a three component system of (a) HX (where X is chlorine, bromine or iodine), MeCHXOR, or EtCHXOR (where R is a hetero atom-substituted alkyl), (b) $SnX_4$, $SnX_2$, $ZnX_2$, or $TiX_4$ as Lewis acids, and (c) Ra4N+BRb4− or Ra4P+BRb4− (where Ra is a primary or secondary alkyl or aralkyl, and Rb is halo or alkyl-substituted aromatic hydrocarbyl).

In U.S. Pat. No. 3,541,015, it is disclosed that ethyl vinyl ether is copolymerized with a comonomeric compound of the formula $CH_2{=}CHOR$, wherein R is phenyl or alkyl of from 3 to 30 carbon atoms to give a copolymer containing from 20 to 85 weight percent of said comonomeric compound. The resulting copolymer is said to be soluble in hydrocarbon lubricating oils and exhibits a unique combination of properties such as viscosity index.

Other published articles include Kanazawa, A. et al., *Macromolecules* 2009, 42, 3965-3972; Kanazawa, A. et al., *Chem. Lett.,* 2010, 39, 1232-1237; Sawamoto, M., *Prog. Polym. Sci.,* 1991, 16, 111-172; Aoshima, S. et al., *Macromolecules,* 1989, 22, 1010-1013; and Kishimoto, Y. et al., *Macromolecules,* 1989, 22, 3877-3882.

There is a need to provide for the synthesis of high performance PVEs using a controlled living cationic polymerization process. There is also a need for a new class of synthetic fluids containing a general chemical composition similar to PAO but with built-in oxygen functionality in the form of ether functional groups. There is further a need for PVEs with varying molecular weight, varying polarity and low molecular weight distributions (MWDs). These needs are met through applicants' present disclosure, which follows, wherein one or more vinyl ether monomers are reacted in a controlled living cationic polymerization process.

SUMMARY

In one of the embodiments of the present disclosure, there is provided a process for preparing polyvinyl ether fluid, the process comprising the steps of sequentially adding an initiator comprised of a vinyl ether-organic acid adduct followed by one or more Lewis acid catalysts, a weak base, to a vinyl ether monomer, maintaining contact between the vinyl ether and the Lewis acid catalyst under conditions and for a time sufficient to effect a desired degree of polymerization and, in further optional steps, quenching the polymerization and recovering the polyvinyl ether. Preferably, the process comprises using vinyl ether monomer of the general formula $CH_2$═CH—O—R wherein R is comprised of a branched or linear alkyl group having at least 4 carbon atoms. The process also generally comprises using a vinyl ether-organic acid adduct of general formula R'OOC—($CH_3$)CH—O—R wherein R is a branched or linear alkyl group containing 2-20 carbon atoms, and R' is hydrogen, methyl, or linear or branched alkyl group containing 2-8 carbon atoms. Also preferably, the Lewis acid catalyst is selected from ethylaluminum dichloride, diethylaluminum chloride, ethylaluminum sesquichloride, $AlCl_3$, $BF_3$, $AlBr_3$, $TiCl_3$, and $TiCl_4$.

In another embodiment of the present disclosure, there is provided a polyvinyl ether fluid comprised of repeating vinyl ether units of the general formula —[$CH_2$—CH(O—R)]$_n$, wherein R is comprised of a branched or linear alkyl group having at least 4 carbon atoms and n is a whole number representing the average number of repeating units in the polyvinyl ether. Preferably, the polyvinyl ether fluid has an MWD of less than 2, more preferably between 1 and 1.5, still more preferably between 1 and 1.2, and most preferably between 1 and 1.1. The PVE fluid also preferably has a VI of from 100 to 500. Most preferably, the polyvinyl ether fluid has an MWD of less than 1.5 and a VI of from 200 to 400.

DETAILED DESCRIPTION

All numerical values within the detailed description and the claims herein are modified by "about" or "approximately" the indicated value, and take into account experimental error and variations that would be expected by a person having ordinary skill in the art. Vinyl ethers are an important class of organic molecules with two kinds of functionalities: a reactive polymerizable vinyl double bond and polar ether group. Vinyl ethers can be prepared by the reaction of acetylene and alcohols. The vinyl ether monomers suitable for use in the present disclosure include monomers with long side chains (alkyl chain length of at least 4 or more methylene groups). By changing the alkane portion of vinyl ether molecules by, for example, length, branching or both, or by selecting desired co-monomer precursors, PVEs with varying polarity can be synthesized. Thus, this disclosure discloses a new class of synthetic fluids having lubricating qualities similar to PAO, but with built-in oxygen functionality in the form of ether functional groups as shown in the structures below. For example, octadecyl vinyl ether (A), dodecyl vinyl ether (B), 2-ethylhexyl vinyl ether (C) and butyl vinyl ether (D), below, are among those which can be used. The general reaction schematic for converting these monomers to the oligomers/polymers of the present disclosure is shown below, starting with the desired vinyl alkyl ether precursors of the appropriate alcohol and acetylene.

A

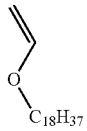

B

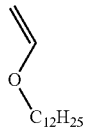

C

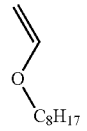

D

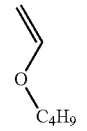

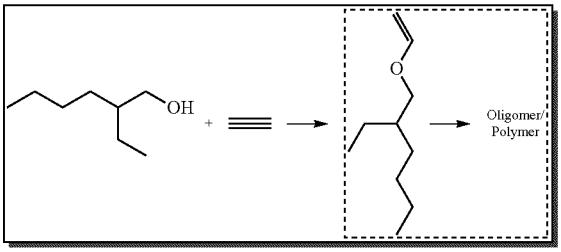

The living polymerization system includes an initiator. The initiator generally comprises a vinyl ether-acetic acid adduct of the general formula R'OOC—($CH_3$)CH—O—R wherein R and R' are as defined above. The living polymerization system is based on using a base-stabilized Lewis acid catalyst system. The initiator/co-initiator (Lewis acid) initiating binary systems are applied for initiating living cationic polymerizations. The purpose of a Lewis acid is to ionize the initiator so that cations can be generated. In order to synthesize polymers with narrow molecular weight distribution, it is important that the rate of initiation is approximately the same as the rate of propagation. The key to a living cationic polymerization is a fast dynamic equilibrium between active species and dormant species. The addition of nucleophilic base not only forms a complex with the growing carbocation, but also reacts with free Lewis acid, thus reducing the Lewis acidity of Lewis acid and thereby suppressing any side reactions associated with it. The effective base includes ethyl acetate and 1,4-dioxane. The general reaction scheme for living polymerization is shown below.

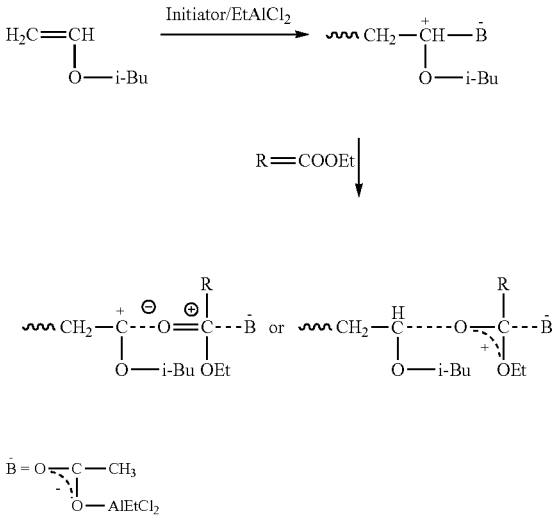

The vinyl ether polymerization of the present disclosure can be carried out using an initiator synthesized by the reaction of the vinyl ether and organic acid adduct, and Lewis acid. The initiator adduct can be prepared by combination of organic acids such as formic acid, acetic acid, propionic acid and the Lewis acid can be any Lewis acid catalyst, including Al, B or zeolite based acids, ionic liquids, etc. The Lewis acid catalysts which may be used for the present polymerization reactions include the metal and metalloid halides conventionally used as Friedel-Crafts catalysts. Preferred examples of Lewis acid catalysts include ethylaluminum dichloride, diethylaluminum chloride, ethylaluminum sesquichloride, $AlCl_3$, $BF_3$, $AlBr_3$, $TiCl_3$, and $TiCl_4$. Solid Lewis acid catalysts, such as synthetic or natural zeolites, acid clays, polymeric acidic resins, amorphous solid catalysts such as silica-alumina may also be used. The general reaction scheme is shown below.

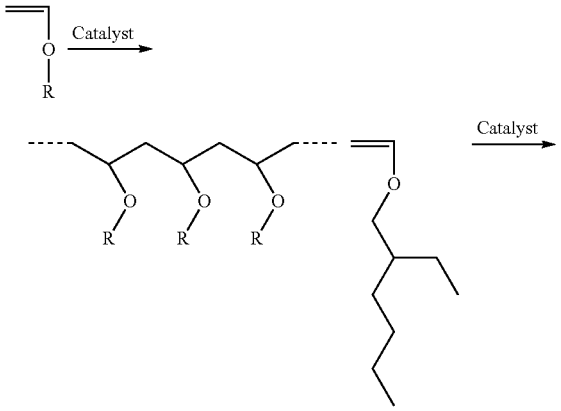

-continued

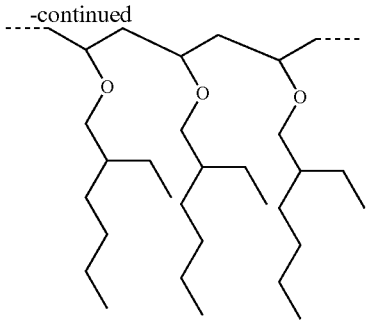

R = Alkyl group (linear or branched) of C4-C20 carbons

To avoid undesired polymerization, it is usually preferred that the overall reaction be conducted under conditions which minimize moisture. Reagents/solvents are preferably anhydrous and it may be desired to dry the reagents/solvents additionally to avoid the presence of moisture. The reaction is also preferably carried out under an inert atmosphere (such as nitrogen) to avoid moisture as well. The polymerization can be conducted with or without a proton trap. The temperature of the Lewis acid-catalyzed polymerization reaction can vary in practical operation but, in the examples which follow, the polymerizations were carried out at or near room temperature (30° C.-40° C.). Following completion of the polymerization reaction, the catalyst activity is quenched by known means and the product is recovered.

The viscosity versus temperature relationship of lubricating oil is one of the criteria which must be considered when selecting a lubricant for a particular application. Viscosity Index (VI) is an empirical, unitless number which indicates the rate of change in the viscosity of a fluid within a given temperature range. Fluids exhibiting a relatively large change in viscosity with temperature are said to have a low VI. Low VI oil, for example, will thin out at elevated temperatures faster than high VI oil. In the usual case, higher VI oil is more desirable because it has higher viscosity at higher temperature, which translates into better or thicker lubrication film and better protection of the contacting machine elements requiring lubrication. The PVE fluid made according to the disclosure generally have an MWD of less than 2 and a VI of from 100 to 500.

The disclosure will now be described with reference to the following examples. These examples are for the purpose of more fully explaining to one of skill in the art the practice of the present disclosure. These examples are not limiting to the full scope of the present disclosure as explained above and as encompassed in the claims which follow.

EXAMPLES

Example 1

Syntheses of Initiator: Isobutyl Vinyl Ether—Acetic Acid Adduct 16.8 ml of isobutyl vinyl ether (IBVE Sigma Aldrich, 99% purity) was placed in a two-neck glass reactor equipped with a stirrer. 5.0 ml of acetic acid (AA, Sigma Aldrich) was added and the reaction mixture was slowly heated to 60° C. The reaction mixture was maintained at 60° C. for 12 hours. After 12 hours, the reaction mixture was cooled to room temperature. The crude product was washed six times with distilled water until the product is neutral. $^1H$ NMR spectroscopy was performed to characterize the IBVE-AA adduct. NMR: —$CH_3$:1.4 (m) ppm; —CHOC—:5.9 (m) ppm; —$OCH_2CH$—:3.4 and 3.2 (m) ppm; —$OCH_2CH$—:1.87 (m) ppm; —$OCOCH_3$:2.07 (m) ppm; —$CH(CH_3)_2$—:0.9 (s) ppm. The isobutyl vinyl ether-acetic acid (IBVE-AA) adduct was used as initiator for the living polymerization of vinyl ether monomers in the examples which follow.

Example 2

Living Polymerization of Isobutyl Vinyl Ether (IBVE) without Proton Trap in Hexane at Room Temperature Using Ethylaluminum Dichloride (EADC) as Lewis Acid Polymerization was carried out under a dry nitrogen moisture free atmosphere in baked glass tubes (culture tubes). The total volume of each reaction mixture was kept at 15 ml. Polymerization was performed in a non-polar solvent (hexane). Anhydrous hexane (Sigma Aldrich, 96% purity) was dried further by using molecular sieves (Sigma Aldrich, 13X, 1.67 mm pellets) and Oxiclear™ disposable gas purifier (Sigma Aldrich). Similarly, IBVE (Sigma Aldrich, 99% purity) was purified by washing with 10 wt. % KOH solutions and dried over KOH pellets overnight. Finally, before polymerization, the monomer was distilled under reduced pressure. Ethyl acetate (Sigma Aldrich, 99% purity) was used without further purification. The molecular weight expected at 100% conversion is 19,000 g/mole. The reaction was initiated by sequential addition of AA-IBVE (0.004 M) and ethylaluminum dichloride (Sigma Aldrich, 1.0 M solution in hexane) $EtAlCl_2$ (0.004 M) into IBVE (0.76 M) solution containing ethyl acetate (1.0 M) Anhydrous hexane was added to bring the total volume of the reaction mixture to15 ml. After 15, 30, 60 and 150 minute polymerization times, the solutions were quenched with ammoniacal methanol. The quenched reaction mixtures were washed with dilute hydrochloric acid followed by water to remove initiator residues, evaporated to dryness under reduced pressure, and vacuum dried overnight to give the product polymers. The conversion of product was measured gravimetrically. The product polymer samples were dissolved in THF, and molecular weight ($M_n$) and molecular weight distribution (MWD) were measured using GPC (PS standard, flow rate 1 ml/min). The conversion and molecular weight data are shown in Table 1.

TABLE 1

Molecular weight and % Conversion of poly(isobutyl vinyl ether)

| Sample # | Time (min.) | Conv. % | $M_n$ (g/mole) | MWD |
|---|---|---|---|---|
| 1 | 15 | 46 | 11,525 | 1.14 |
| 2 | 30 | 73 | 16,830 | 1.12 |
| 3 | 60 | 76 | 18,148 | 1.11 |
| 4 | 150 | 99 | 20,635 | 1.11 |

The molecular weight and polydispersity as a function of conversion and semi-logarithmic kinetic plots of the polymerization exhibit living polymerization.

Example 3

Living Polymerization of Isobutyl Vinyl Ether (IBVE) with Proton Trap in Hexane at Room Temperature Using Ethylaluminum Dichloride as Lewis Acid Living cationic polymerization of isobutyl vinyl ether was carried out in glove box in culture tubes. The total volume of each reaction was kept 15 ml. Hexane was used as polymerization solvent Anhydrous hexane (same as in Example 2) was dried further by using molecular sieves (same as in Example 2) and Oxiclear™. Similarly, IBVE (same as in Example 2) was purified by washing with 10 wt. % KOH solutions and dried over KOH pellets overnight. Finally, before the polymerization the monomer was distilled under reduced pressure. Ethyl acetate (same as in Example 2) was dried further by storing over molecular sieves (13X) and Oxiclear™. 0.006 M of 2,6 di-tert-butyl pyridine (Sigma Aldrich, >97% purity) was used as proton scavenger to prevent moisture initiation of the polymerization. The molecular weight expected at 100% conversion was 19,000 g/mole. The reaction was initiated by sequential addition of AA-IBVE (0.004 M) and ethylaluminum dichloride (same as Example 2) $EtAlCl_2$ (0.004 M) into IBVE (0.76 M) solution containing ethyl acetate (1.0 M) Anhydrous hexane was added to bring the total volume of each reaction mixture to 15 ml. After 60, 120 and 180 minute polymerization times, the solutions were quenched with ammoniacal methanol. The quenched reaction mixtures were purified with hexane/methanol and finally washed with dilute hydrochloric acid followed by water to remove initiator residues, evaporated to dryness under reduced pressure, and vacuum dried overnight to give the product polymers. The conversion of product was measured gravimetrically. The samples were dissolved in THF, and molecular weight ($M_n$) and molecular weight distribution (MWD) was measured using GPC (PS standard, flow rate 1 ml/min). The conversion and molecular weight data are shown in Table 2.

TABLE 2

Molecular weight and Conversion % of poly(isobutyl vinyl ether)

| Sample # | Time (min.) | Conv. % | $M_n$ (g/mole) | (MWD) |
|---|---|---|---|---|
| 1 | 60 | 47 | 8900 | 1.18 |
| 2 | 120 | 69 | 13,000 | 1.16 |
| 3 | 180 | 82 | 14,000 | 1.15 |

The molecular weight and polydispersity as a function of conversion and semi-logarithmic kinetic plots indicates that the polymerization exhibits living polymerization.

Example 4

Living Polymerization of Isobutyl Vinyl Ether (IBVE) with Proton Trap in Hexane at Room Temperature Using Titanium Tetrachloride as Lewis Acid Polymerization was carried out under a dry nitrogen moisture free atmosphere in baked glass tubes (culture tubes). The total volume of each reaction mixture was kept at 15 ml. Polymerization was performed in hexane Anhydrous hexane (same as Example 2) was dried further by using molecular sieves (same as Example 2) and Oxiclear™. Similarly, IBVE (same as Example 2) was further purified by washing with 10 wt. % KOH solutions and dried over KOH pellets overnight. Finally, before polymerization, the monomer was distilled under reduced pressure. Ethyl acetate (same as Example 2) was dried further by storing over molecular sieves (13X) and Oxiclear™. 0.006 M of 2,6 di-tert-butyl pyridine (same as Example 3) was used as proton scavenger to remove any extraneous residual moisture. The molecular weight expected at 100% conversion was 19,000 g/mole. The reaction was initiated by sequential addition of 0.004 M AA-IBVE and 0.005 M titanium tetrachloride (Sigma Aldrich, $TiCl_4$) into 0.76 M IBVE solution containing ethyl acetate (1.0 M). Anhydrous hexane was added to bring the total volume of each reaction mixture to 15 ml. After 60, 120 and 180 minute polymerization times, the solutions were quenched with ammoniacal methanol. The quenched reaction mixtures were purified with hexane/methanol and finally washed with dilute hydrochloric acid followed by water to remove initiator residues, evaporated to dryness under reduced pressure, and vacuum dried overnight to give the product polymers. The conversion of product was measured gravimetrically. The samples were dissolved in THF, and molecular weight ($M_n$) and molecular weight distribution (MWD) were measured using GPC (PS standard, flow rate 1 ml/min). The conversion and molecular weight data are shown in Table 3.

TABLE 3

Molecular weight and Conversion % of poly(isobutyl vinyl ether)

| Sample # | Time (min) | Conv. % | $M_n$ (g/mole) | MWD |
|---|---|---|---|---|
| 1 | 60 | 43 | 5540 | 1.20 |
| 2 | 120 | 60 | 6400 | 1.14 |
| 3 | 180 | 78 | 7200 | 1.10 |

The molecular weight and polydispersity as a function of conversion and semi-logarithmic kinetic plots indicate that the polymerization exhibits living polymerization.

Example 5

Living Polymerization of Isobutyl Vinyl Ether (IBVE) with Proton Trap in Hexane at Room Temperature Using Ethyl Aluminum Dichloride and Dioxane Polymerization was carried out under a dry nitrogen moisture free atmosphere in baked glass tubes. The total volume of each reaction mixture was 15 ml. Polymerization was performed in hexane. Anhydrous hexane (same as Example 2) was dried further by using molecular sieves (same as Example 2) and Oxiclear™. Similarly, IBVE (same as Example 2) was purified by washing with 10 wt. % KOH solutions and dried over KOH pellets overnight. Finally, before polymerization, the monomer was distilled under reduced pressure. 1,4 dioxane (Sigma Aldrich, 99%) was dried further by storing over molecular sieves (13X) and Oxiclear™. 0.006 M of 2,6 di-tert-butyl pyridine (same as Example 3) was used as proton scavenger to remove any extraneous residual moisture. The molecular weight expected at 100% conversion was 19,000 g/mole. The reaction was initiated by sequential addition of AA-IBVE (0.004 M) and ethylaluminum dichloride (same as Example 2) $EtAlCl_2$ (0.004 M) into IBVE (0.76 M) solution containing 1,4 dioxane (1.0 M) Anhydrous hexane was added to bring the total volume of the reaction mixture to 15 ml. After a 220 minute polymerization time, the polymerization mixture was quenched with ammoniacal methanol. The quenched reaction mixture was purified with hexane/methanol and finally washed with dilute hydrochloric acid followed by water to remove initiator residues, evaporated to dryness under reduced pressure, and vacuum dried overnight to give the product polymer. The conversion of product was measured gravimetrically. The sample was dissolved in THF, and molecular weight ($M_n$) and molecular weight distribution (MWD) was measured using GPC (PS standard, flow rate 1 ml/min). The conversion and molecular weight data are shown in Table 4.

TABLE 4

Molecular weight and Conversion % of poly(isobutyl vinyl ether)

| Sample # | Time (min.) | Conv. % | $M_n$ (g/mole) | MWD |
|---|---|---|---|---|
| 1 | 220 | 96 | 17229 | 1.10 |

Example 6

Living Polymerization of Dodecyl Vinyl Ether (DDVE) with Proton Trap in Hexane at Room Temperature Using Ethylaluminum Dichloride as Lewis Acid Controlled living cationic polymerization was performed in culture tubes in dry glove box. The total volume of each reaction mixture was kept at 15 ml. Polymerization was carried out in hexane. Anhydrous hexane (same as Example 2) was dried further by using molecular sieves (same as Example 2) and Oxiclear™ disposable gas purifier. Similarly, DDVE (Sigma Aldrich, 98% purity) was purified by washing with 10 wt. % KOH solutions and dried over KOH pellets overnight. Finally, before polymerization, the monomer was distilled under reduced pressure. Ethyl acetate (same as Example 2) was dried further by storing over molecular sieves (13X) and Oxiclear™. 0.006 M of 2,6 di-tert-butyl pyridine (same as Example 3) was used as proton scavenger to remove any extraneous residual moisture. The molecular weight expected at 100% conversion was 42,400 g/mole. The reaction was initiated by sequential addition of AA-IBVE (0.002 M) and 0.01 M of ethylaluminum dichloride (same as Example 2) $EtAlCl_2$ into 0.4 M of DDVE solution containing ethyl acetate (0.5 M). Anhydrous hexane was added to bring the total volume of the reaction mixtures to 15 ml. After 15 and 60 minute polymerization times, the solutions were quenched with ammoniacal methanol. The quenched reaction mixtures were purified with hexane/methanol and finally washed with dilute hydrochloric acid followed by water to remove initiator residues, evaporated to dryness under reduced pressure, and vacuum dried overnight to give the product polymers. The conversion of product was measured gravimetrically. The samples were dissolved in THF, and molecular weight ($M_n$) and molecular weight distribution (MWD) were measured using GPC (PS standard, flow rate 1 ml/min). The conversion and molecular weight data are shown in Table 5.

TABLE 5

Molecular weight and Conversion % of poly(dodecyl vinyl ether)

| Sample # | Time (min.) | Conv. % | $M_n$ | MWD |
|---|---|---|---|---|
| 1 | 15 | 71 | 21,000 | 1.12 |
| 2 | 60 | 97 | 30,000 | 1.11 |

The molecular weight and polydispersity as a function of conversion and semi-logarithmic kinetic plots indicate that the polymerization exhibits living polymerization.

Example 7

Living Polymerization of Dodecyl Vinyl Ether (DDVE) with Proton Trap in Hexane at Room Temperature Using Diethylaluminum Chloride ($Et_2AlCl$) as Lewis Acid Living polymerization of dodecyl vinyl ether was performed in hexane at room temperature in baked culture tubes in a moisture free atmosphere under a dry blanket of nitrogen. The total volume of the reaction mixtures was kept at 15 ml. Anhydrous hexane (same as Example 2) was dried further by using molecular sieves (same as Example 2) and Oxiclear™. Similarly, DDVE (same as Example 6) was purified by washing with 10 wt. % KOH solutions and dried over KOH pellets overnight. Finally, before polymerization, the monomer was distilled under reduced pressure. Ethyl acetate (same as Example 2) was dried further by storing over molecular sieves (13X) and Oxiclear™. 0.006 M of 2,6 di-tert-butyl pyridine (same as Example 3) was used as such as proton scavenger. The molecular weight expected at 100% conversion was 22,000 g/mole. The reaction was initiated by sequential addition of AA-IBVE (0.004 M) and 0.02 M of $Et_2AlCl$ (same as Example 2) into 0.4 M of DDVE solution containing ethyl acetate (1.0 M) Anhydrous hexane was added to bring the total volume of each reaction mixture to 15 ml. After 60 and 90 minute polymerization times, the solutions were quenched with ammoniacal methanol. The quenched reaction mixtures were purified with hexane/methanol and finally washed with dilute hydrochloric acid followed by water to remove initiator residues, evaporated to dryness under reduced pressure, and vacuum dried overnight to give the product polymers. The conversion of product was measured gravimetrically. The samples were dissolved in THF, and molecular weight ($M_n$) and molecular weight distribution (MWD) were measured using GPC (PS standard, flow rate 1 ml/min). The conversion and molecular weight data are shown in Table 6.

TABLE 6

Molecular weight and Conversion % of poly(dodecyl vinyl ether)

| Sample # | Time (min.) | Conv. % | $M_n$ (g/mole) | MWD |
|---|---|---|---|---|
| 1 | 60 | 64 | 14,900 | 1.35 |
| 2 | 90 | 72 | 16,800 | 1.41 |

The molecular weight and polydispersity as a function of conversion and semi-logarithmic kinetic plots indicate that the polymerization exhibits living polymerization.

Example 8

Living Polymerization of Dodecyl Vinyl Ether (DDVE) with Proton Trap in Hexane at Room Temperature Using Ethylaluminum Sesquichloride ($Et_{1.5}AlCl_{1.5}$) as Lewis Acid Polymerization was carried out under a dry nitrogen moisture free atmosphere in baked glass tubes. The total volume of each reaction mixture was kept at 15 ml. Polymerization was performed in hexane Anhydrous hexane (same as Example 2) was dried further by using molecular sieves (same as Example 2) and Oxiclear™. Similarly, DDVE (same as Example 6) was purified by washing with 10 wt. % KOH solutions and dried over KOH pellets overnight. Finally, before polymerization, the monomer was distilled under reduced pressure. Ethyl acetate (same as Example 2) was dried further by storing over molecular sieves (13X) and Oxiclear™. 0.006 M of 2,6 di-tert-butyl pyridine (same as Example 3) was used as proton scavenger to remove any extraneous residual moisture. The molecular weight expected at 100% conversion was 22,000 g/mole. The Lewis acid $Et_{1.5}AlCl_{1.5}$ of 0.02 M was obtained by mixing 0.1M of $EtAlCl_2$ and 0.1M of $Et_2AlCl$ in 10 ml of hexane. The reaction was initiated by sequential addition of AA-IBVE (0.004 M) and 0.01 M of $Et_{1.5}AlCl_{1.5}$ into 0.4 M of DDVE solution containing ethyl acetate (1.0 M). Anhydrous hexane was added to bring the total volume of each reaction mixture to 15 ml. After 60 and 90 minute polymerization times, the solutions were quenched with ammoniacal methanol. The quenched reaction mixtures were purified with hexane/methanol and finally washed with dilute hydrochloric acid followed by water to remove initiator residues, evaporated to dryness under reduced pressure, and vacuum dried overnight to give the product polymers. The conversion of product was measured gravimetrically. The samples were dissolved in THF, and molecular weight ($M_n$) and molecular weight distribution (MWD) was measured using GPC (using polystyrene standard, flow rate 1 ml/min). The conversion and molecular weight data are shown in Table 7.

TABLE 7

Molecular weight and Conversion % of poly(dodecyl vinyl ether)

| Sample # | Time (min.) | Conv. % | $M_n$ (g/mole) | MWD |
|---|---|---|---|---|
| 1 | 60 | 86 | 19,100 | 1.15 |
| 2 | 90 | 87 | 19,200 | 1.10 |

The molecular weight and polydispersity as a function of conversion and semi-logarithmic kinetic plots indicate that the polymerization exhibits living polymerization.

Example 9

Polymerization of Octadecyl Vinyl Ether (ODVE) with Proton Trap in Hexane at Room Temperature Using Ethylaluminum Sesquichloride ($Et_{1.5}AlCl_{1.5}$) as Lewis Acid Controlled cationic polymerization was carried out in a moisture free atmosphere under a blanket of dry nitrogen in baked glass tubes. The total volume of each reaction mixture was kept at 15 ml. The polymerization solvent was hexane. Anhydrous hexane (same as Example 2) was dried further by using molecular sieves (same as Example 2) and Oxiclear™. Similarly, ODVE (TCI) was purified by distilling under reduced pressure prior to polymerization. Ethyl acetate (same as Example 2) was dried further by storing over molecular sieves (13X) and Oxiclear™. 0.006 M of 2,6 di-tert-butyl pyridine (same as Example 3) was used as proton scavenger to remove any extraneous residual moisture. The molecular weight expected at 100% conversion was 29,600 g/mole. The Lewis acid $Et_{1.5}AlCl_{1.5}$ of 0.02 M was obtained by mixing 0.1 M of $EtAlCl_2$ and 0.1 M of $Et_2AlCl$ in 10 ml of hexane. The reaction was initiated by sequential addition of AA-IBVE (0.004 M) and 0.02 M of $Et_{1.5}AlCl_{1.5}$ into 0.4 M of ODVE solution containing ethyl acetate (1.0 M). Anhydrous hexane was added to bring the total volume of the reaction mixtures to 15 ml. After 15, 30 and 60 minute polymerization times, the solutions were quenched with ammoniacal methanol. The quenched reaction mixtures were purified with hexane/methanol and finally washed with dilute hydrochloric acid followed by water to remove initiator residues, evaporated to dryness under reduced pressure, and vacuum dried overnight to give the product polymers. The conversion of product was measured gravimetrically. The samples were dissolved in THF, and molecular weight ($M_n$) and molecular weight distribution (MWD) were measured using GPC (PS standard, flow rate 1 ml/min). The conversion and molecular weight data are shown in Table 8.

TABLE 8

Molecular weight and Conversion % of poly(octadecyl vinyl ether)

| Sample # | Time (min.) | Conv. % | $M_n$ (g/mole) | MWD |
|---|---|---|---|---|
| 1 | 15 | 80 | 9600 | 1.12 |
| 2 | 30 | 88 | 11,200 | 1.11 |
| 3 | 60 | 94 | 16,600 | 1.14 |

The molecular weight and conversion increased with time. However, there is deviation from expected linear plots, suggesting possible chain-transfer and chain termination.

Example 10

Living Polymerization of Dodecyl Vinyl Ether (DDVE) with Proton Trap in Hexane at Room Temperature Using Ethylaluminum Dichloride $EtAlCl_2$ as Lewis Acid Polymerization was carried out in a moisture free atmosphere under dry nitrogen in a baked glass tube. The total volume of the reaction mixture was kept at 100 ml. Polymerization was performed in a non-polar solvent (hexane). Anhydrous hexane (same as Example 2) was dried further by using molecular sieves (same as Example 2) and Oxiclear™. Similarly, DDVE (same as Example 6) was purified by washing with 10 wt. % KOH solutions and dried over KOH pellets overnight and distilled under reduced pressure prior to polymerization. Ethyl acetate (same as Example 2) was dried further by storing over molecular sieves (13X) and Oxiclear™. 0.006 M of 2,6 di-tert-butyl pyridine (same as Example 3) was used as proton scavenger to remove any extraneous residual moisture. The molecular weight expected at 100% conversion was 42,400 g/mole. The reaction was initiated by sequential addition of 0.002 M of AA-IBVE and 1 ml of 1.0 M of $EtAlCl_2$ (same as Example 2) into 0.4 M of DDVE solution in ethyl acetate (0.5 M). Anhydrous hexane was added to bring the total volume of the reaction mixture to 100 ml. After a 60 minute polymerization time, the solution was quenched with ammoniacal methanol. The quenched reaction mixture was purified with hexane/methanol and finally washed with dilute hydrochloric acid followed by water to remove initiator residues. The low boiling components (hexane and methanol) were removed by rotovapory and the high boiling component (DDVE) was removed by air bath oven at 160-170° C. under high vacuum. Gravimetric yield: 88%. The samples were dissolved in THF, and molecular weight ($M_n$) and molecular weight distribution (MWD) were measured using GPC (PS standard, flow rate 1 ml/min). The product was characterized by IR. IR: ($cm^{-1}$): 2924, 2854, 1466, 1377, 1110, 809, 721; GPC: $M_n$: 30,000, MWD: 1.07

The kinematic viscosity (Kv) of the liquid product was measured using ASTM standards D-445 and reported at temperatures of 100° C. (Kv at 100° C.) and 40° C. (Kv at 40° C.). The viscosity index (VI) was measured according to ASTM standard D-2270 using the measured kinematic viscosities for each product. The viscosity of the reaction product at 100° C. was 468 cSt and at 40° C. was 4350 cSt with a viscosity index (VI) of 288. The viscometric data suggest that the fluid has good lubricant properties. The data are compared with PAO 300 as shown below

TABLE 9

The Lube Properties of the Basestocks

| Fluid | $Kv_{100}$ | $Kv_{40}$ | VI |
|---|---|---|---|
| Example 10 | 468 | 4350 | 288 |
| PAO 300 | 300 | 3100 | 241 |

Example 11

Living Polymerization of Dodecyl Vinyl Ether (DDVE) with Proton Trap in Hexane at Room Temperature Using Ethylaluminum Dichloride $EtAlCl_2$ as Lewis Acid Polymerization was carried out in a moisture free atmosphere under dry nitrogen in a baked glass tube. The total volume of the reaction mixture was kept at 400 ml. Polymerization was performed in hexane Anhydrous hexane (same as Example 2) was dried further by using molecular sieves (same as Example 2) and Oxiclear™ disposable gas purifier. Similarly, DDVE (same as Example 6) was purified by washing with 10 wt. % KOH solutions and dried over KOH pellets overnight and distilled under reduced pressure prior to polymerization. Ethyl acetate (same as Example 2) was dried further by storing over molecular sieves (13X) and Oxiclear™. 0.006 M of 2,6 di-tert-butyl pyridine (same as Example 3) was used as a proton scavenger to remove any extraneous residual moisture. The molecular weight expected at 100% conversion was 42,400 g/mole. The reaction was initiated by sequential addition of 0.002 M of AA-IBVE and 4 ml of 1.0 M of $EtAlCl_2$ (same as Example 2) into 0.4 M of DDVE solution containing ethyl acetate (0.5 M). Anhydrous hexane was added to bring the total volume of the reaction mixture to 400 ml. After a 15 minute polymerization time, the solution was quenched with ammoniacal methanol. The quenched reaction mixture was purified with hexane/methanol and finally washed with dilute hydrochloric acid followed by water to remove initiator residues. The low boiling components (hexane and methanol) were removed by rotovapory and the high boiling component (DDVE) was removed by air bath oven at 160-170° C. under high vacuum. Gravimetric yield: 40%. The sample was dissolved in THF, and molecular weight ($M_n$) and molecular weight distribution (MWD) were measured using GPC (PS standard, flow rate 1 ml/min). The product was characterized by IR. IR: ($cm^{-1}$): 2924, 2853, 1466, 1377, 1100, 810, 721. GPC: $M_n$: 17,500; MWD: 1.08.

The kinematic viscosity (Kv) of the liquid product was measured using ASTM standards D-445 and reported at temperatures of 100° C. (Kv at 100° C.) and 40° C. (Kv at 40° C.). The viscosity index (VI) was measured according to ASTM standard D-2270 using the measured kinematic viscosities for the product. The viscosity of the product at 100° C. was 175 cSt at 40° C. was 1485 cSt with a viscosity index (VI) of 243. The viscometric data suggest that the fluid has good lubricant properties. The data are compared with PAO 300 as shown below. It is noteworthy that PAO300's VI of 241 can be exceed by poly(dodecyl vinyl ether) of $Kv_{100}$ of 176 cSt fluid. With a $Kv_{100}$ of 176, one would expect the VI to be substantially lower, i.e. in the range of approximately 210

TABLE 10

The Lube Properties of the Basestocks

| Fluid | $Kv_{100}$ | $Kv_{40}$ | (VI) |
|---|---|---|---|
| Example 11 | 176 | 1485 | 243 |
| PAO 300 | 300 | 3100 | 241 |

All of these polymers were soluble in mPAOs, PAOs, GTL and Visom (Gr. III) basestocks. These PVE fluids as such or their blends can be used as lube basestocks. These synthetic fluids can be used in finished lubricant formulation to provide energy efficiency in automotive engine lubricants, in industrial or drive-line lubricants, in gas engine or marine lubricants.

In addition to the above-mentioned vinyl ethers, other vinyl ethers may be used as a monomer or as co-monomer with other vinyl ethers containing different alkyl groups. Thus, these would yield copolymers of vinyl ethers. Vinyl ethers can also be copolymerized with alpha-olefins such as 1-decene, 1-octene, 1-dedecene and the like to make copolymers of vinyl ethers and alpha-olefins.

PCT and EP Clauses:

1. A composition comprising one or more compounds containing repeating units of the general formula —[$CH_2$—CH(O—R)]$_n$ wherein R is comprised of a branched or linear alkyl group having at least 4 carbon atoms and n is a whole number representing the average number of repeating units, wherein said composition has an MWD of less than 2.

2. The composition of clause 1 wherein R is between 4 and 20.

3. The composition of clauses 1-2 wherein the VI is between 100 and 500.

4. The composition of clauses 1-3 having a pour point (PP)≤30° C.

5. A composition comprising one or more compounds containing repeating vinyl ether units of the general formula —[$CH_2$—CH(O—R)]$_n$, wherein R is comprised of a branched or linear alkyl group having at least 4 carbon atoms and n is a whole number representing the average number of repeating units, wherein said composition has an MWD of less than 2 and wherein said composition is produced by reacting one or more vinyl ether monomers (R≥4) or combinations thereof in the presence of an initiator and Lewis acid catalyst under conditions and for a time sufficient to produce said composition.

6. The composition of clause 5 wherein said composition has a viscosity ($Kv_{100}$)≥2, a viscosity index (VI)≥100, a molecular weight distribution (MWD) of less than 2 and a pour point (PP) of ≤30° C.

7. A lubricating oil base stock comprising one or more compounds represented by the general formula —[$CH_2$—CH(O—R)]$_n$, wherein R is comprised of a branched or linear alkyl group having at least 4 carbon atoms and n is a whole number representing the average number of repeating units, and wherein said compound has a viscosity ($Kv_{100}$)≥2, a viscosity index (VI)≥100, a molecular weight distribution (MWD) of less than 2, and a pour point (PP) of ≤30° C.

8. A lubricating oil comprising a lubricating oil base stock as a major component, and one or more compounds represented by the general formula —[$CH_2$—CH(O—R)]$_n$, wherein R is comprised of a branched or linear alkyl group having at least 4 carbon atoms and n is a whole number representing the average number of repeating units, and wherein said compound has a viscosity ($Kv_{100}$)≥2, a viscosity index (VI)≥100, a molecular weight distribution (MWD) of less than 2, and a pour point (PP) of ≤30° C.

9. The lubricating oil of clause 8 wherein the lubricating oil base stock comprises a Group I, II, III, IV or V base oil stock.

10. The lubricating oil of clauses 8-9 wherein the lubricating oil base stock is comprised of a poly alpha olefin (PAO) or gas-to-liquid (GTL) oil base stock.

11. The lubricating oil of clauses 8-10 wherein the lubricating oil base stock is present in an amount of from 50 weight percent to 99 weight percent, and the one or more compounds represented by the general formula —[$CH_2$—CH(O—R)]$_n$ is present in an amount from 1 weight percent to 50 weight percent, based on the total weight of the lubricating oil.

12. The lubricating oil of clauses 8-11 wherein the lubricating oil further comprises one or more of a viscosity improver, antioxidant, detergent, dispersant, pour point depressant, corrosion inhibitor, metal deactivator, seal compatibility additive, anti-foam agent, inhibitor or antirust additive.

13. The lubricating oil of clauses 8-12 which is passenger vehicle engine oil.

14. A process for preparing a composition, said process comprising:

a. contacting one or more vinyl ether monomers of the general formula $CH_2$=CH—O—R, wherein R is comprised of a branched or linear alkyl group having at least 4 carbon atoms, with one or more vinyl ether-organic acid adducts and one or more Lewis acid catalysts; and b. maintaining contact between the vinyl ether and the vinyl ether-organic acid adduct and Lewis acid catalyst under conditions and for a time sufficient to produce said composition.

15. The process of clause 14 wherein R is comprised of a branched or linear alkyl group having between 4 and 20 carbon atoms.

16. The process of clauses 14-15 wherein at least two different vinyl ethers are used.

17. The process of clauses 14-16 wherein the vinyl ether-organic acid adduct is of general formula R'OOC—($CH_3$)CH—O—R and wherein R is a branched or linear alkyl group having linear or branched alkyl group containing 4-20 carbon atoms and R' is hydrogen, methyl, or linear or branched alkyl group containing 2-8 carbon atoms.

18. The process of clauses 14-17 wherein R is a butyl group and R' is hydrogen or methyl.

19. The process of clauses 14-18 wherein the Lewis acid catalyst is selected from Friedel-Crafts catalysts.

20. The process of clauses 14-19 wherein the Lewis acid catalyst is selected from ethylaluminum dichloride, diethylaluminum chloride, ethylaluminum sesquichloride, $AlCl_3$, $BF_3$, $AlBr_3$, $TiCl_3$, and $TiCl_4$.

21. The process of clauses 14-20 wherein the conditions comprise conducting the process under an inert atmosphere.

22. The process of clauses 14-21 wherein the conditions comprise conducting the process using substantially anhydrous reagents.

23. The process of clauses 14-22 further comprising the step of quenching the reaction and the quenching is performed by addition of ammoniacal methanol.

24. A method for improving one or more of solubility and dispersancy of polar additives in a lubricating oil by using as the lubricating oil a formulated oil comprising a lubricating oil base stock as a major component, and one or more compounds represented by the general formula —[$CH_2$—CH(O—R)]$_n$, wherein R is comprised of a branched or linear alkyl group having at least 4 carbon atoms and n is a whole number representing the average number of repeating units, and wherein said compound has an MWD of less than 2.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above, but rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims.

While several embodiments in accordance with the disclosure have been shown and described, it is to be clearly understood that the same may be susceptible to numerous changes apparent to one skilled in the art. Therefore, the disclosure is not limited to the details shown and described but is intended to show all changes and modifications that come within the scope of the appended claims.

All of the patents and publications mentioned herein are incorporated by reference into this application, as if fully set forth herein, for all that such patents and publications contain in their written disclosures.

What is claimed is:

1. A composition comprising one or more compounds containing repeating units of the general formula —[$CH_2$—CH (O—R)]$_n$, wherein R is comprised of a branched or linear alkyl group having at least 4 carbon atoms and n is a whole number representing the average number of repeating units, wherein said composition has an MWD of between 1.0 and 1.5 and a Kinematic Viscosity at 100° C. of 2 to 468 cSt with the proviso that the composition does not include a (meth) acrylate comonomer.

2. A composition according to claim 1, wherein R is between 4 and 20.

3. A composition according to claim 1, wherein the MWD is between 1 and 1.2.

4. A composition according to claim 1, wherein the MWD is between 1 and 1.1.

5. A composition according to claim 1, having a viscosity index (VI)≥100.

6. A composition according to claim 5, wherein the VI is between 100 and 500.

7. A composition according to claim 6, wherein the VI is between 200 and 400.

8. A composition according to claim 1, having a pour point (PP)≤30° C.

9. A composition comprising one or more compounds containing repeating units of the general formula —[CH2-CH (O—R)]n, wherein R is comprised of a branched or linear alkyl group having at least 4 carbon atoms and n is a whole number representing the average number of repeating units, wherein said composition has an MWD of between 1.0 and 1.5 and a Kinematic Viscosity at 100° C. of 2 to 468 cSt with the proviso that the composition does not include a (meth) acrylate comonomer and wherein said composition is produced by reacting one or more vinyl ether monomer (R≥4) or combinations thereof in the presence of an initiator and Lewis acid catalyst under conditions and for a time sufficient to produce said composition.

10. A composition according to claim 9, wherein said composition has a viscosity index (VI)≥100, and a pour point (PP) of ≤30° C.

11. A lubricating oil base stock comprising one or more compounds represented by the general formula —[CH2-CH (O—R)]n, wherein R is comprised of a branched or linear alkyl group having at least 4 carbon atoms and n is a whole number representing the average number of repeating units, and wherein said compound has a MWD of between 1.0 and 1.5 and a Kinematic Viscosity at 100° C. of 2 to 468 cSt with the proviso that the composition does not include a (meth) acrylate comonomer, a viscosity index (VI)≤100, and a pour point (PP) of ≥30° C.

12. A lubricating oil comprising a lubricating oil base stock as a major component, and one or more compounds represented by the general formula —[CH2-CH (O—R)]n, wherein R is comprised of a branched or linear alkyl group having at least 4 carbon atoms and n is a whole number representing the average number of repeating units, and wherein said compound has a MWD of between 1.0 and 1.5 and a Kinematic Viscosity at 100° C. of 2 to 468 cSt with the proviso that the composition does not include a (meth)acrylate comonomer, a viscosity index (VI)≥100, and a pour point (PP) of ≤30° C.

13. The lubricating oil of claim 12, wherein the lubricating oil base stock comprises a Group I, II, III, IV or V base oil stock.

14. The lubricating oil of claim 13, wherein the lubricating oil base stock comprises a poly alpha olefin (PAO) or gas-to-liquid (GTL) oil base stock.

15. The lubricating oil of claim 12, wherein the lubricating oil base stock is present in an amount from 50 weight percent to 99 weight percent, and the one or more compounds represented by the general formula —[CH2-CH (O—R)]n is present in an amount from 1 weight percent to 50 weight percent, based on the total weight of the lubricating oil.

16. The lubricating oil of claim 12, wherein the lubricating oil further comprises one or more of a viscosity improver, antioxidant, detergent, dispersant, pour point depressant, corrosion inhibitor, metal deactivator, seal compatibility additive, anti-foam agent, inhibitor or antirust additive.

17. The lubricating oil of claim 16 which is passenger vehicle engine oil.

18. A process for preparing a composition, said process comprising:

a. contacting one or more vinyl ether monomers of the general formula $CH_2$=CH—O—R, wherein R is comprised of a branched or linear alkyl group having at least 4 carbon atoms, with one or more vinyl ether-organic acid adducts and one or more Lewis acid catalysts; and b. maintaining contact between the vinyl ether and the vinyl ether-organic acid adduct and Lewis acid catalyst under conditions and for a time sufficient to produce said composition, wherein the composition includes one or more compounds containing repeating units of the general formula —[$CH_2$—CH (O—R)]$_n$, wherein R is comprised of a branched or linear alkyl group having at least 4 carbon atoms and n is a whole number representing the average number of repeating units, wherein said composition has an MWD of between 1.0 and 1.5 and a Kinematic Viscosity at 100° C. of 2 to 468 cSt with the proviso that the composition does not include a (meth) acrylate comonomer.

19. A process according to claim 18, wherein R is comprised of a branched or linear alkyl group having between 4 and 20 carbon atoms.

20. A process according to claim 18, wherein at least two different vinyl ethers are used.

21. A process according to claim 18, wherein the vinyl ether-organic acid adduct is of general formula R'OOC—(CH3)CH—O—R, and wherein R is a branched or linear alkyl group having linear or branched alkyl group containing 4-20 carbon atoms and R' is hydrogen, methyl, or linear or branched alkyl group containing 2-8 carbon atoms.

22. A process according to claim 21, wherein R is a butyl group and R' is hydrogen or methyl.

23. A process according to claim 18, wherein the Lewis acid catalyst is selected from Friedel-Crafts catalysts.

24. A process according to claim 18, wherein the Lewis acid catalyst is selected from ethylaluminum dichloride, diethylaluminum chloride, ethylaluminum sesquichloride, AlCl3, BF3, AlBr3, TiCl3, and TiCl4.

25. A process according to claim 18, wherein the conditions comprise conducting the process under an inert atmosphere.

26. A process according to claim 18, wherein the conditions comprise conducting the process using substantially anhydrous reagents.

27. A process according to claim 18, further comprising the step of quenching the reaction and the quenching is performed by addition of ammoniacal methanol.

28. A method for improving one or more of solubility and dispersancy of polar additives in a lubricating oil by using as the lubricating oil a formulated oil comprising a lubricating oil base stock as a major component, and one or more compounds represented by the general formula —[CH2-CH(O—R)]n, wherein R is comprised of a branched or linear alkyl group having at least 4 carbon atoms and n is a whole number representing the average number of repeating units, and wherein said compound has an MWD of between 1.0 and 1.5 and a Kinematic Viscosity at 100° C. of 2 to 468 cSt with the proviso that the composition does not include a (meth) acrylate comonomer.

* * * * *